US008217713B1

(12) United States Patent
Raghavan et al.

(10) Patent No.: US 8,217,713 B1
(45) Date of Patent: Jul. 10, 2012

(54) HIGH PRECISION CURRENT REFERENCE USING OFFSET PTAT CORRECTION

(75) Inventors: Vijay Kumar Srinivasa Raghavan, Colorado Springs, CO (US); Cristinel Zonte, Colorado Springs, CO (US)

(73) Assignee: Cypress Semiconductor Corporation, San Jose, CA (US)

( * ) Notice: Subject to any disclaimer, the term of this patent is extended or adjusted under 35 U.S.C. 154(b) by 603 days.

(21) Appl. No.: 11/975,967

(22) Filed: Oct. 22, 2007

Related U.S. Application Data

(60) Provisional application No. 60/854,534, filed on Oct. 24, 2006.

(51) Int. Cl.
*G05F 1/10* (2006.01)

(52) U.S. Cl. ..... 327/539; 327/538; 327/541; 323/313; 323/315

(58) Field of Classification Search ..... 327/538, 327/539, 541, 543; 323/313, 315, 316
See application file for complete search history.

(56) References Cited

U.S. PATENT DOCUMENTS

| | | | | |
|---|---|---|---|---|
| 5,177,376 | A * | 1/1993 | Wellnitz et al. | 327/205 |
| 5,889,394 | A * | 3/1999 | Czarnocki | 323/313 |
| 6,297,685 | B1 * | 10/2001 | Ewen et al. | 327/513 |
| 6,992,533 | B2 | 1/2006 | Hollinger et al. | |
| 7,150,561 | B1 * | 12/2006 | D'Aquino et al. | 374/178 |
| 7,173,481 | B2 | 2/2007 | Kimura | |
| 7,218,167 | B2 | 5/2007 | Chatal et al. | |
| 7,224,210 | B2 | 5/2007 | Garlapati et al. | |
| 7,301,321 | B1 | 11/2007 | Uang et al. | |
| 7,321,225 | B2 | 1/2008 | Garlapati et al. | |
| 7,372,316 | B2 | 5/2008 | Chatterjee et al. | |
| 7,411,443 | B2 | 8/2008 | Ivanov et al. | |
| 7,852,144 | B1 | 12/2010 | Zonte et al. | |
| 2007/0080740 | A1 | 4/2007 | Berens et al. | |

OTHER PUBLICATIONS

Oguey et al., "CMOS Current Reference Without Resistance," IEEE Journal of Solid-State Circuits, vol. 32, No. 7, Jul. 1997, pp. 1132-1135; 4 pages.
USPTO Notice of Allowance for U.S. Appl. No. 11/904,642 dated May 18, 2010; 6 pages.
USPTO Non-Final Rejection for U.S. Appl. No. 11/904,642 dated Sep. 18, 2009; 8 pages.
USPTO Non-Final Rejection for U.S. Appl. No. 11/904,642 dated Feb. 23, 2009; 6 pages.

* cited by examiner

*Primary Examiner* — Lincoln Donovan
*Assistant Examiner* — Shikha Goyal

(57) ABSTRACT

A device for providing a high precision current reference comprising a PTAT generator circuit for supplying a voltage, a high precision current reference offset generator circuit for generating a high precision current offset to compensate for variation in a resistance component due to variation in temperature, and a current adding circuit for aggregating the current from the PTAT generator circuit and the current from the high precision current reference offset generator circuit. In one embodiment, a high precision current reference generated is substantially independent of temperature. On-chip resistors may be used to design a high precision current reference. Accordingly, high precision current reference generated maintains high precision with zero temperature co-efficient using on-chip resistors that are substantially cheaper than off-chip resistors.

6 Claims, 7 Drawing Sheets

200

200

HIGH PRECISION CURRENT REFERENCE USING OFFSET PTAT CORRECTION

RELATED APPLICATIONS

This application claims the benefit and priority to a provisional application Ser. No. 60/854,534, inventors Raghavan et al., entitled "HIGH PRECISION CURRENT REFERENCE USING OFFSET PTAT CORRECTION" that was filed on Oct. 24, 2006 and assigned to the same assignee. The above-cited provisional application is incorporated herein in its entirety.

TECHNICAL FIELD

The present invention relates to the field of electronics. More particularly, embodiments of the present invention relate to non-volatile memory macros with minimum area for embedded applications.

BACKGROUND ART

A number of electronic components depend upon accurate reference currents to provide reliable results. Precision current references are often utilized in a variety of applications including precision delay stages, current sensing circuits for read paths in memories and timing circuits. However, maintaining relatively high accuracy and precision of such reference currents across process voltage and temperature (PVT) variations is usually very difficult and expensive.

Non-volatile memory macros with minimum area for embedded applications often utilize a reference current. These applications often use single ended memory bit cells instead of differential bit cells to conserve area. Relatively precise current references are utilized in the read sense path in order for such memory macros using single ended sensing schemes to have a fast read access along with good sense margin. These relatively precise current references are then used to design precision delay stages for use in the sense timing path or as a reference current to compare against in a current sensing scheme.

Traditional attempts at providing a precise current reference are usually expensive and often limited in precision. For example, given a zero temperature co-efficient (TC) voltage reference (e.g., a band gap reference), the classical way of getting a current reference is by designing a circuit that will give a current of Vref/R. FIG. 1A shows a conventional circuit for a current reference using a constant voltage reference. One way to keep the reference current constant with temperature variation is to use a resistor with zero temperature co-efficient and a reference voltage with zero temperature co-efficient.

Unfortunately, resistors with zero temperature coefficients are in general external resistors and expensive to implement. On the other hand if on-chip resistors are used, the current reference becomes affected by the temperature coefficients of the on-chip resistors. As a result, accuracy of on-chip resistors is very low, e.g., between a % and ±15%. Moreover, the total accuracy across all PVT corners is between ±20% and ±25%.

In other traditional attempts, a current reference based on a proportional to absolute temperature (PTAT) voltage applied to a positive TC resistor (e.g., serial and parallel combination of resistors) is utilized. The resulting resistor should have the TC equal to the PTAT voltage ($TC_R = TC_{PTAT}$). FIG. 1B shows a conventional circuit for a current reference based on an equivalent resistor. The current reference is constant if the resistor's TC equals the PTAT voltage TC as provided by the $\Delta V_{be}$ of the two bipolar junctions. Unfortunately, this condition is difficult to satisfy in practice because TC of $\Delta V_{be}$ has only linear terms proportional to T whereas the TC of the resistor has an offset, linear and higher order polynomials terms. Thus, this circuit requires expensive external resistors or a very critical process controlled on chip resistor. Moreover, processes in general do not use resistors with large TC as the PTAT voltage.

Another conventional attempt utilizes an Oguey's Current Reference (Ref: "CMOS Current Reference Without Resistance" by Henri J. Oguey, vol. 32, No. 7, p. 573, July 1997). There are other current references based on Vt (e.g., threshold of MOSFET) where in the final current reference is given by Vt/R. The current references mentioned above usually require either special off-chip expensive resistors or vary a lot across PVT. FIG. 1C shows a conventional Oguey's current reference circuit. Unfortunately, the Oguey's circuit has approximately $T^{0.5}$ dependence on temperature presuming that the mobility varies as $T^{-1.5}$ for the temperature ranging between −40 C to 145 C. Thus, the accuracy become ±15% across this temperature range and the total accuracy varies between ±20% and ±25% across all PVT. Unfortunately, the Oguey circuit uses transistors in sub-threshold region, which leaves the circuit vulnerable to mismatch related inaccuracies.

SUMMARY

Accordingly, a need has arisen to generate a high precision current reference that is substantially independent of temperature variations. Moreover, a need has arisen to generate a high precision current reference that may be implemented economically (e.g., by using an on-chip resistor) and accurately. Furthermore, a need has risen to generate a high precision current reference that is not prone to mismatch related inaccuracies. It will become apparent to those skilled in the art in view of the detailed description of the present invention that the present invention remedies the above mentioned needs.

In one embodiment of the present invention, a high precision voltage compensating circuit is designed and applied to a circuit with a voltage supply and a resistance component with a positive first order temperature co-efficient such that the high precision voltage compensating circuit compensates for resistance variation due to temperature variation. As a result, a high precision current reference is generated. In one embodiment of the present invention, the high precision current reference is substantially independent of temperature. As a result of using the high precision voltage compensating circuit and generating a high precision current reference independent of temperature, on-chip resistors may be used. Therefore, the use of on-chip resistors results in a less expensive and accurate implementation in comparison to using an off-chip resistor. Furthermore, embodiments of the present invention are less prone to mismatch related inaccuracies because transistors are designed to work in deep-inversion saturation region instead of sub-threshold region.

More specifically, one embodiment of the present invention is a circuit for providing a high precision current reference, the circuit includes a high precision current reference offset generator circuit for accepting a high precision voltage reference and for generating a high precision current offset to compensate for resistance variations associated with temperature changes on a load such that a substantially constant high precision current reference is maintained, wherein the high precision current reference is substantially independent of temperature; a PTAT generator circuit for supplying voltage, wherein the PTAT generator circuit is a positive temperature co-efficient voltage source, and wherein the PTAT generator circuit generates a PTAT current reference; and a current adding circuit for adding currents from the high precision current reference offset generator circuit and from the PTAT generator circuit, wherein the current adding circuit produces the high precision current reference by combining the high precision current offset and the PTAT current reference.

In one embodiment of the present invention, the high precision current reference offset generator circuit includes an operational amplifier, wherein the operational amplifier receives said high precision voltage reference as an input, and wherein the operational amplifier amplifies the voltage difference at its inputs; a PMOS transistor coupled to the output of the operational amplifier; and a resistance component coupled to the PMOS transistor and further coupled to the operational amplifier, wherein the resistance along with the operational amplifier and the PMOS transistor are capable of generating the high precision current offset. Embodiments include the above and wherein the PTAT generator circuit includes a first and a second PMOS transistors coupled to each other; an operational amplifier, wherein the output of the operational amplifier is coupled to the gates of the first and the second PMOS transistors, and wherein inputs of the operational amplifier is coupled to the drains of the first and the second PMOS transistors; and a first PNP bipolar transistor's emitter is coupled to a resistive component for generating the PTAT reference current; and a second PNP transistor's emitter is coupled to the second PMOS transistor.

In one embodiment, the high precision current reference substantially equals a constant divided by the product of the value of the resistive load at a reference temperature and its first order temperature co-efficient, and wherein the constant is proportional to a natural logarithm of a product of a first parameter and a second parameter. The embodiments include the above and wherein the first parameter is the ratio of a current through the second and the first PMOS transistors, and wherein the second parameter is the ratio of the area of the first and the second PNP bipolar transistors.

According to one embodiment, the current adding circuit includes a first current mirror for mirroring the high precision current offset; and a second current mirror, coupled to the first current mirror, for mirroring the PTAT component of the current reference such that the combination of the high precision current offset and the PTAT reference current produces the high precision current reference. The high precision voltage reference, according to one embodiment, equals a product of a first parameter and a second parameter, wherein the first parameter is substantially a constant divided by the first order temperature co-efficient of the load, and wherein the second parameter is one minus the product of the first order temperature co-efficient of the load and a reference temperature.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Reference will now be made in detail to embodiments of the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details. In other instances, well known methods, procedures, components, and circuits have not been described in detail as not to unnecessarily obscure aspects of the invention.

High Precision Current Reference Using Offset PTAT Correction

In one embodiment of the present invention, a high precision voltage compensating circuit is designed and applied to a circuit with a voltage supply and a resistance component with a positive first order temperature co-efficient such that an offset voltage compensates for resistance variation due to temperature variation. The high precision voltage compensating circuit should be designed such that a high precision reference current is independent of temperature variations.

Figure 1A:
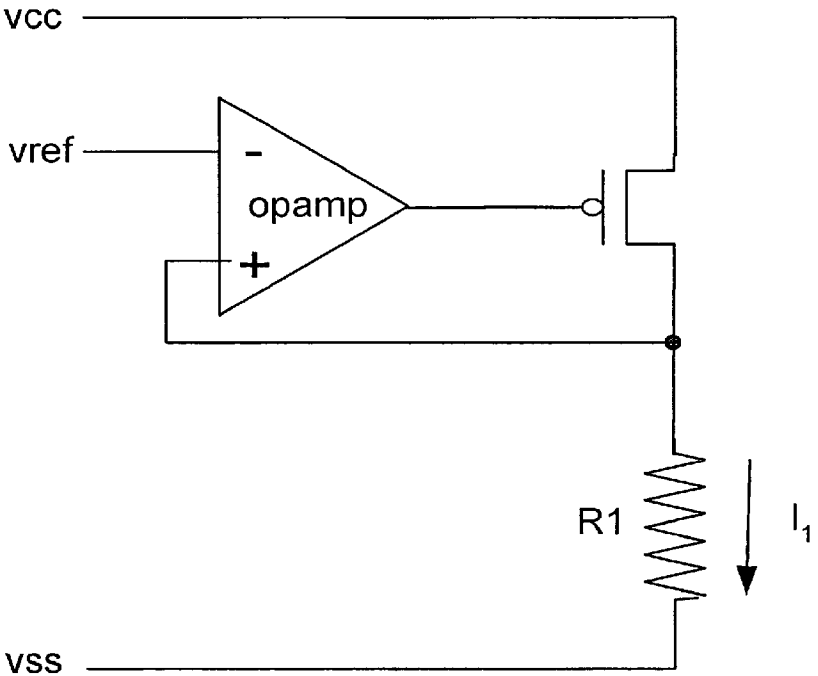
Related Art FIGURE 1A
FIG. 1A shows a prior art current reference using a constant voltage reference.
Figure 1B:
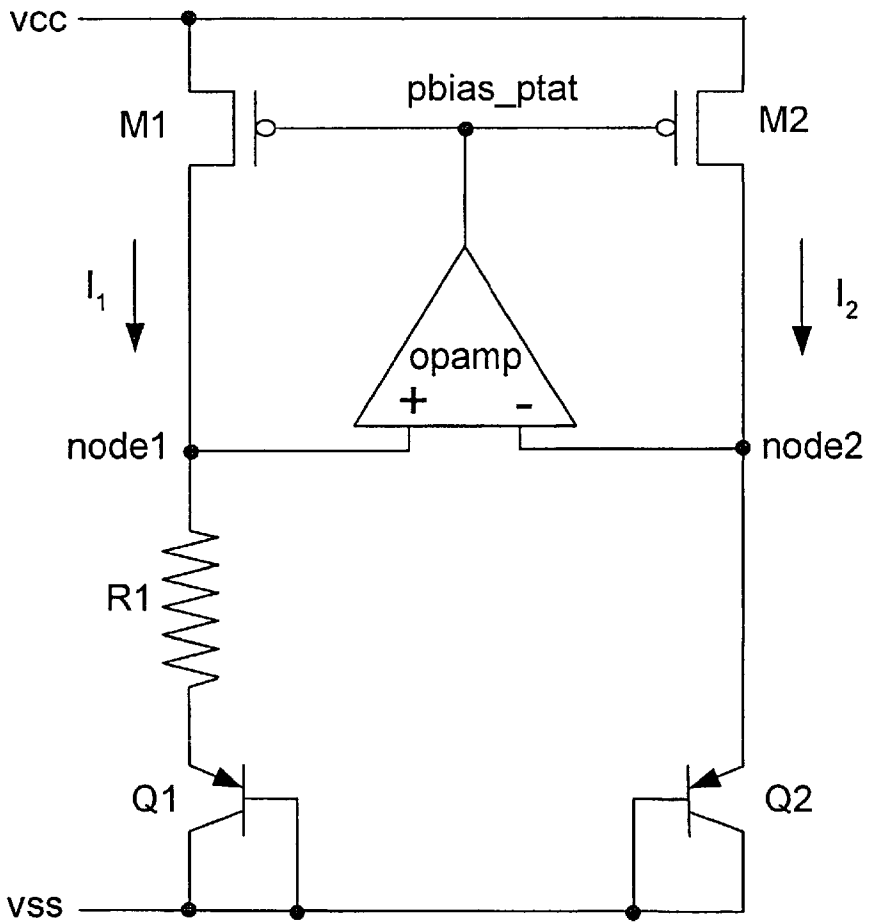
Related Art FIGURE 1B
FIG. 1B shows a prior art current reference based on an equivalent resistor.
Figure 1C:
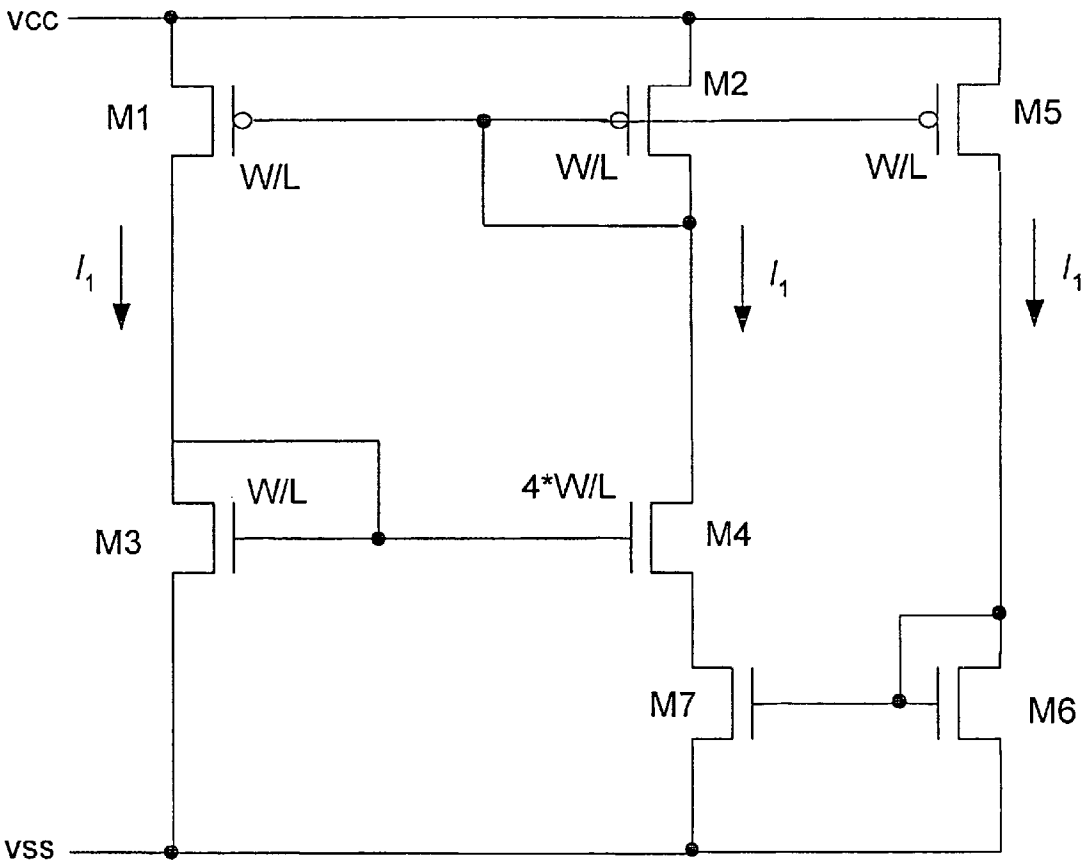
Related Art FIGURE 1C
FIG. 1C shows a prior art Oguey's current reference.
Figure 2:
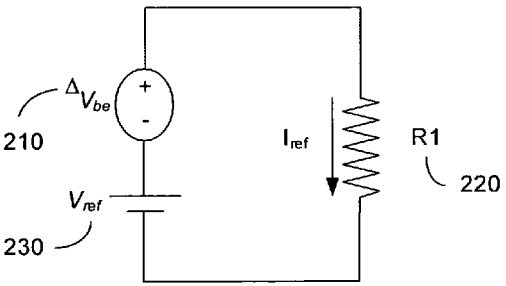
FIG. 2 shows an exemplary circuit for generating a novel high precision current reference in accordance with one embodiment of the present invention.

Referring now to FIG. 2, an exemplary circuit 200 for a novel high precision current reference in accordance with one embodiment of the present invention is shown. The circuit 200 has a voltage source $\Delta V_{bc}$ 210 coupled to a resistance component $R_1$ 220. In this example, the voltage source 210 and the resistance component 220 are assumed to have a positive temperature co-efficient. Accordingly, the value of the voltage source 210 and the resistance component 220 change in response to temperature variation. In order to compensate for changes in temperature, a high precision voltage compensating circuit $V_{ref}$ 230 is coupled to the voltage source 210 and the resistance component 220. In one embodiment, the high precision voltage compensating circuit $V_{ref}$ 230 is a zero temperature co-efficient circuit. As such, the high precision voltage compensating circuit $V_{ref}$ 230 provides a voltage reference to compensate for temperature variation in the resistance component 220 such that a high precision current reference, independent of temperature is generated.

The current reference $I_{ref}$ may be expressed in the following form:

$$I_{ref} = \frac{V_{ref} + \Delta V_{be}}{R_1} \quad \text{equation (1)}$$

As discussed above, $V_{ref}$ 230 may be a zero temperature co-efficient circuit (e.g., a bandgap circuit). The voltage source $\Delta V_{ref}$ 210 is a positive temperature co-efficient circuit. In one embodiment, the $\Delta V_{be}$ 210 may be a base-emitter voltage differential (PTAT) of two bipolar junction transistors of different areas. The resistance component 220 is a positive temperature co-efficient. Accordingly, the value of the resistance component changes with temperature variations. The resistance component may be expressed in the following form:

$$R_1 = R_0(1+\alpha(T-T_0)) \quad \text{equation (2)}$$

$R_0$ may be the resistance component value at a reference temperature $T_0$. The temperature co-efficient may be represented by $\alpha$. In one embodiment, $\alpha$ is a first order temperature co-efficient of the resistor. In one embodiment, higher order co-efficients are neglected since they are negligible. The value of the resistance component 220 changes with variation in temperature, e.g., $T-T_0$. In order for the high precision current reference to be accurate, its value should be made independent of temperature variation. The derivation of high precision current that is independent of variation in temperature is to follow.

In one embodiment, the voltage source $\Delta V_{be}$ 210 is substantially proportional to temperature. Accordingly, $\Delta V_{be}=CT$, wherein C is substantially a constant and T is the temperature in Kelvin. Setting $\Delta V_{be}$ 210 to CT, and setting the resistance component value according to equation (2) and substituting them in equation (1) may be represented in the following form:

$$I_{ref} = \frac{V_{ref} + CT}{R_0(1 + \alpha(T - T_0))} \quad \text{equation (3)}$$

In order to obtain the high precision current reference that is independent of temperature, partial differentiation of the equation (3) may be performed. Partial differentiation of equation (3) with respect to temperature may be represented in the following form:

$$\frac{\partial I_{ref}}{\partial T} = 0 \quad \text{equation (4)}$$

Accordingly, taking partial differentiation of equation (3) with respect to temperature T and simplifying the equation may be represented in the following form:

$$R_0(1 + \alpha(T - T_0))\left[\frac{\partial V_{ref}}{\partial T} + C\right] = [V_{ref} + CT]R_0\alpha \quad \text{equation (5)}$$

However, as discussed above, the $V_{ref}$ 230 is a zero temperature co-efficient circuit. Accordingly, $$\frac{\partial V_{ref}}{\partial T} = 0$$

and equation (5) can now be represented in the following form:

$$CR_0[1+\alpha(T-T_0)] = [V_{ref}+CT]R_0\alpha \quad \text{equation (6)}$$

Accordingly, the high precision voltage compensating circuit $V_{ref}$ 230 may be represented in the following form:

$$V_{ref} = \frac{C(1 - \alpha T_0)}{\alpha} \quad \text{equation (7)}$$

Accordingly, the high precision voltage compensating circuit $V_{ref}$ 230 is substantially constant and independent of temperature variation. Substituting equation (7) in equation (3) results in a high precision current reference that is independent of temperature and may be represented in the following form:

$$I_{ref} = \frac{C}{R_0\alpha} \quad \text{equation (8)}$$

Accordingly, as long as the high precision voltage compensating circuit $V_{ref}$ 230 satisfies the expression in equation (7), the high precision current reference remains substantially constant and would be independent of temperature as shown in equation (8).

Figure 3:
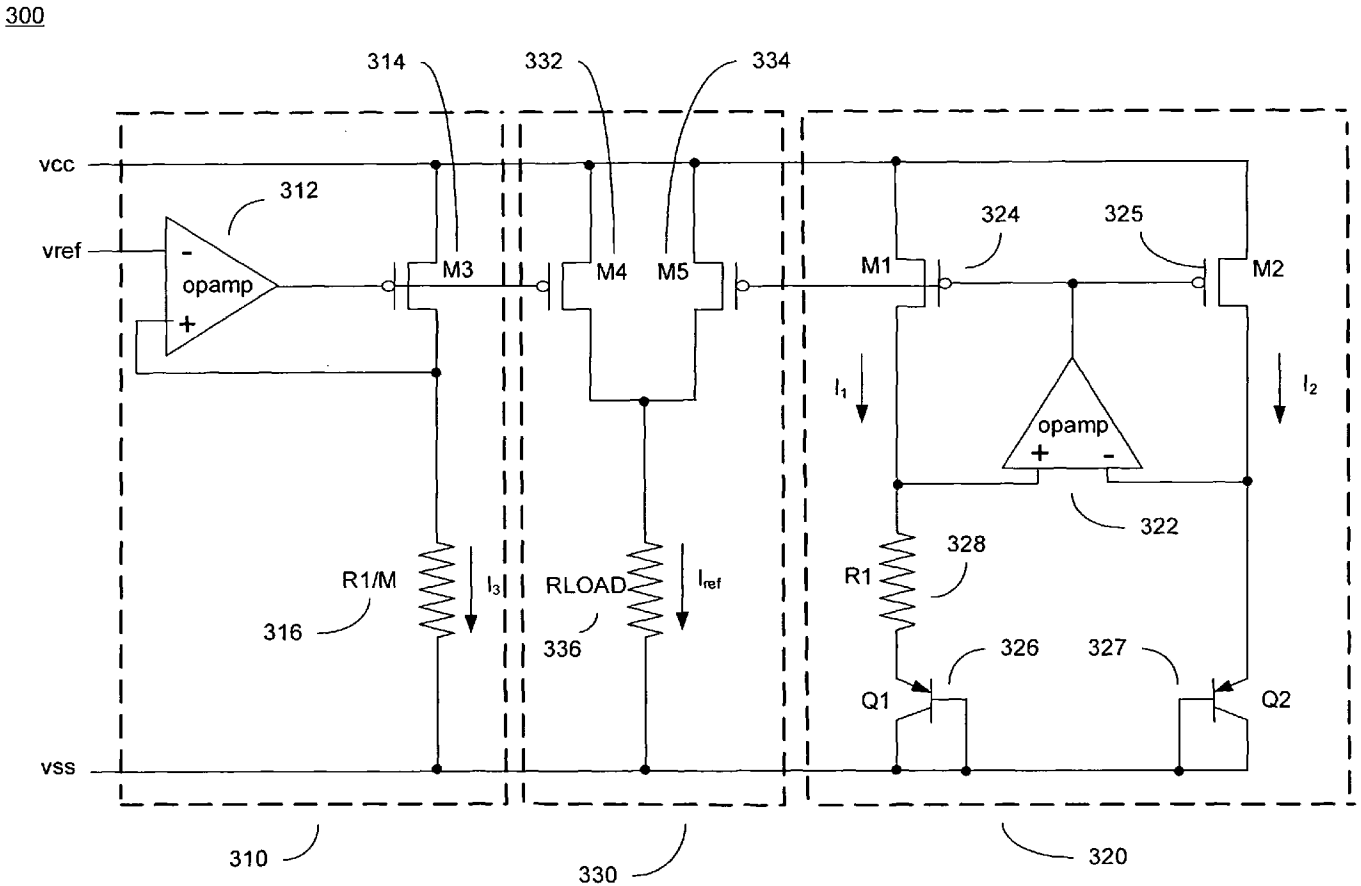
FIG. 3 shows an exemplary current reference implementation using offset correction in accordance with one embodiment of the present invention.

Referring now to FIG. 3, an exemplary circuit 300 for a current reference implementation using offset correction in accordance with one embodiment of the present invention is shown. The circuit 300 may include a PTAT generator circuit 320 coupled to a high precision voltage compensating circuit 310. The current from the PTAT generator circuit 320 and the current from the high precision voltage compensating circuit 310 may be aggregated by current adding circuit 330 to produce a high precision current reference. The high precision current reference generated according to this embodiment is substantially independent of temperature.

The PTAT generator circuit 320 comprises a first PMOS transistor 324 and a second PMOS transistor 325. The source of the first and the second PMOS transistors 324 and 325 may be coupled to a voltage source $V_{CC}$. The gates of the first and the second PMOS transistors 324 and 325 may be coupled to one another as well as being coupled to the output of an operational amplifier 322. The drain of the first and the second PMOS transistors 324 and 325 may be coupled to the input of the operational amplifier 322.

Referring still to FIG. 3, the first PMOS transistor 324 may be coupled to a resistance component 328 further coupled to the emitter of a first PNP bipolar junction transistor 326. The second PMOS transistor 325 may be coupled to the emitter of a second PNP bipolar junction transistor 327. The gate and the collector of the first and the second PNP bipolar junction transistors 326 and 327 may be coupled to $V_{SS}$. The current through the first PMOS transistor 324, the resistance component 328 and the emitter of the first PNP bipolar junction transistor 326 is $I_1$. Similarly, the current through the second PMOS transistor 325 and the emitter of the second PNP bipolar junction transistor 327 is $I_2$. The base-emitter voltage differential (PTAT) of the two bipolar junction transistors 326 and 327 may be represented in the following form:

$$\Delta V_{be} = I_1 R_1 \quad \text{equation (9)}$$

The current through the second PMOS transistor 325 is related to the current through the first PMOS transistor 324. The first and the second PMOS transistors 324 and 325 are sized such that the relationship between the first and the second current may be represented in the following form:

$$I_2 = NI_1 \quad \text{equation (10)}$$

The area of the first PNP bipolar junction transistor 326 is assumed to be proportionally related to the area of the second PNP bipolar junction transistor 327. The relationship between the area of the two PNP bipolar junction transistors may be represented in the following form:

$$\text{Area}_{Q_1} = P \cdot \text{Area}_{Q_2} \quad \text{equation (11)}$$

As discussed above, $\Delta V_{be} = CT$, wherein C is substantially a constant and T is the temperature in Kelvin where C may be represented in the following form:

$$C = \left(\frac{K}{q}\right)\ln(NP) \quad \text{equation (12)}$$

where q is the electron charge in Coulombs and where K is a Boltzmann constant. Substituting equation (12) in equation (9) may be represented in the following form:

$$I_1 = \frac{\left(\left(\frac{KT}{q}\right)\ln(NP)\right)}{R_0[1 + \alpha(T - T_0)]} \quad \text{equation (13)}$$

Referring still to FIG. 3, the high precision voltage compensating circuit 310 may include an operational amplifier 312 where its output is coupled to the gate of a PMOS transistor 314. The source of the PMOS transistor 314 may be coupled to $V_{CC}$. The drain of the PMOS transistor 314 may be coupled to the input of the operational amplifier 312 as well as being coupled to a resistance component $R_1/M$ 316 where M is introduced for adding flexibility setting the reference current $I_{ref}$ in the circuit. The operational amplifier 312 may also have the $V_{ref}$ as its input. As discussed above, in order to provide a high precision current reference that is substantially independent of temperature, the $V_{ref}$ should comply with the relationship according to equation (7). The operational amplifier 312 has an M factor associated with it for added design flexibility in the circuit. Accordingly, the current $I_3$ through the resistance component 316 may be represented in the following form:

$$I_3 = \frac{M \cdot V_{ref}}{R_1} \quad \text{equation (14)}$$

As discussed above the resistance component 316 may be governed by equation (2) above. Accordingly, equation (14) may be represented in the following form:

$$I_3 = \frac{M \cdot V_{ref}}{R_0[1 + \alpha(T - T_0)]} \quad \text{equation (15)}$$

Referring still to FIG. 3, the current adding circuit 330 may comprise two PMOS transistors 332 and 334 in parallel and coupled to a resistive load 336. The current adding circuit 330 is a current mirror wherein the two currents, $I_1$ and $I_3$ from the PTAT generator circuit 320 and the precision voltage compensating circuit 310 respectively are being aggregated to produce the high precision current reference. The high precision current reference may be represented in the following form:

$$I_{ref} = I_1 + I_3 \quad \text{equation (16)}$$

Substituting equations (13) and (14) in equation (16) may be represented in the following form:

$$I_{ref} = \frac{M \cdot V_{ref} + \left(\frac{KT}{q}\right)\ln(NP)}{R_0[1 + \alpha(T - T_0)]} \quad \text{equation (17)}$$

As discussed above in order to maintain a high precision current reference $M.V_{ref}$ is governed by equation (7) discussed above where C is governed by equation (12). Accordingly, $M.V_{ref}$ may be represented in the following form:

$$M \cdot V_{ref} = \frac{(1 - \alpha T_0)\left(\frac{K}{q}\right)\ln(NP)}{\alpha} \quad \text{equation (18)}$$

Accordingly, substituting equation (18) into equation (17) results in a high precision current reference that is substantially independent of temperature. As such, the high precision current reference may be represented in the following form:

$$I_{ref} = \frac{\left(\frac{K}{q}\right)\ln(NP)}{R_0\alpha} \quad \text{equation (19)}$$

Accordingly, the high precision current reference through the resistance component 336 is substantially constant and independent of temperature.

Figure 4:
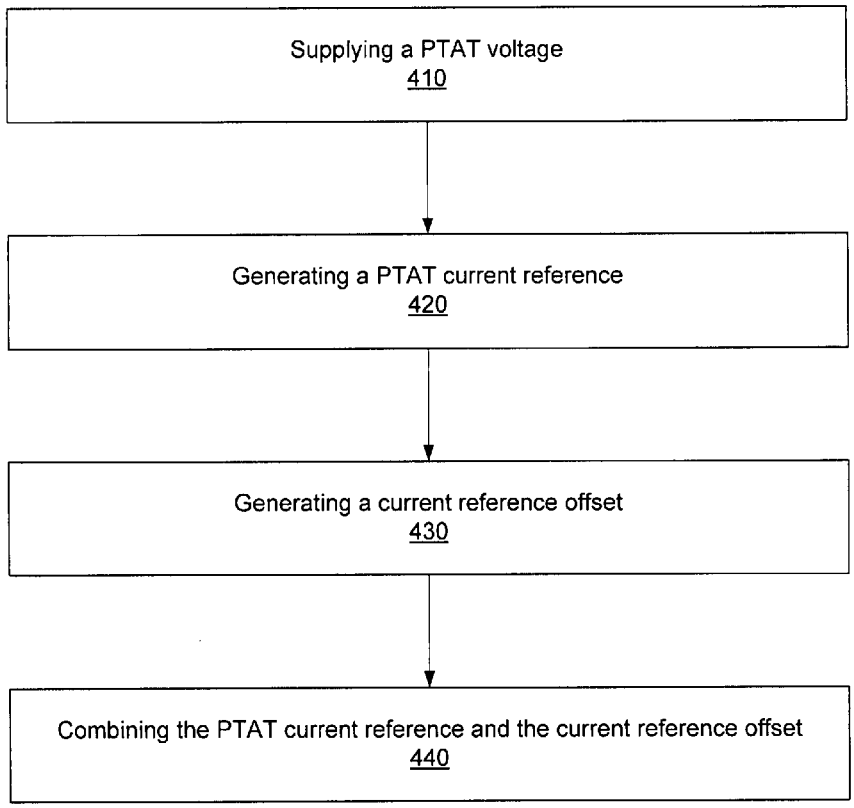
FIG. 4 shows an exemplary flow diagram providing a current reference in accordance with one embodiment of the present invention.

Referring now to FIG. 4, an exemplary flow diagram 400 providing a current reference in accordance with one embodiment of the present invention is shown. At step 410, a PTAT voltage may be supplied via a positive temperature co-efficient voltage source. At step 420, the PTAT voltage may be used to generate a PTAT current reference.

As described above, a PTAT circuitry for supplying the PTAT voltage and generating the PTAT current reference may be implemented using a first and a second PMOS transistors, an operational amplifier, a first PNP bipolar transistor and a second PNP bipolar transistor. For example, the first and the second PMOS transistors may be coupled to one another. The output of the operational amplifier may be coupled to the gates of the first and the second PMOS transistors. The inputs of the operational amplifier may be coupled to the drains of the first and the second PMOS transistors. The first PNP bipolar transistor may be coupled to a resistor component and the second PNP bipolar transistor may be coupled to the second PMOS transistor. The resistor component may be further coupled to the first PMOS transistor for generating the PTAT reference current.

At step 430, a current reference offset is generated. The current reference offset may compensate for resistance variations associated with temperature changes on a load that may be the same as the resistor component. As a result the current reference is maintained substantially constant. The current reference offset may be generated using an operational amplifier, a PMOS transistor and a resistance component. The output of the operational amplifier may be coupled to the gate of the PMOS transistor. The operational amplifier may have a reference voltage as its input. The source of the PMOS transistor may be coupled to $V_{CC}$ and the drain of the PMOS transistor may be coupled to the input of the operational amplifier as well as being coupled to a resistance component for generating the current reference offset.

At step 440, the PTAT current reference and the current reference offset are combined to generate the current reference that is substantially independent of temperature variations. Combining the PTAT current reference and the current reference may be implemented using two current mirrors. For example, a first current mirror may be used to mirror the current offset and a second current mirror may be used to mirror the PTAT reference current. Thus, the two currents may be combined to generate the current reference.

Figure 5:
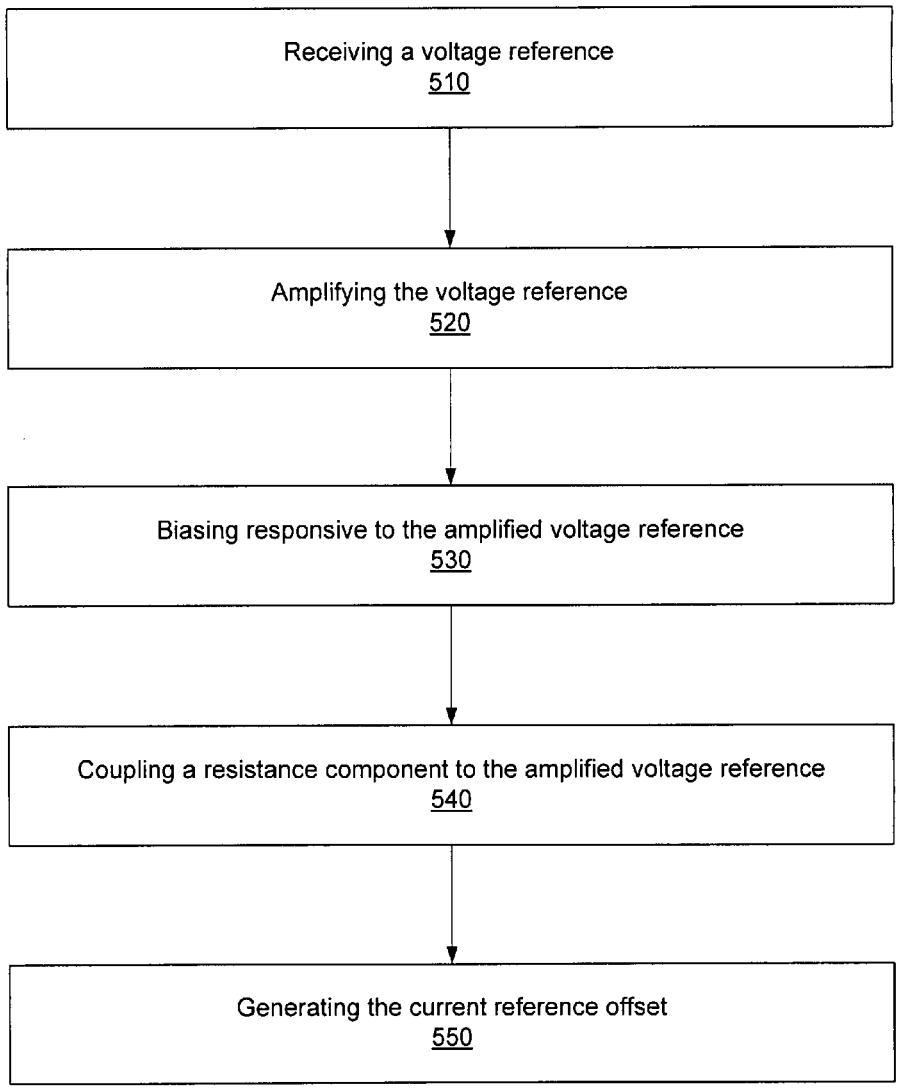
FIG. 5 shows an exemplary flow diagram for generating a current reference offset in accordance with one embodiment of the present invention.

Referring now to FIG. 5, an exemplary flow diagram 500 for generating a current reference offset in accordance with one embodiment of the present invention is shown. At step 510, a voltage reference may be received. At step 520, the received voltage reference may be amplified. At step 530, the circuit is biased in response to the amplified voltage reference. Accordingly, at step 540 a resistance component is selectively biased to the amplified voltage reference. At step 550, coupling the resistance component to the amplified voltage reference generates the current reference offset.

The current reference offset may be generated using an operational amplifier, a PMOS transistor and a resistance component. For example, the operational amplifier may receive and amplify a voltage reference. The PMOS transistor may be used for biasing in response to the amplified voltage reference. The resistance component that may be coupled to the PMOS transistor and the operational amplifier in return generates the current reference offset.

As a result, the high precision current reference is substantially independent of transistor process corner, voltage and temperature variations. It is appreciated that satisfying the conditions set forth in the equations presented above eliminates the need for expensive and ultra low temperature co-efficient resistor. Therefore, any pair of on-chip matched resistors like diffusion, polysilicon, local interconnect or metal resistors may be used. Moreover, the need to add a route to the pads to the external world to connect to the external resistor is eliminated because an on-chip resistor may be used without impacting accuracy. Moreover, using an on-chip resistor saves silicon area that the pads would have occupied if off-chip resistors were used. Furthermore, embodiments of the present invention achieve a high precision current reference with an accuracy of ±2% across temperature variations, ±4% across transistor process, voltage and temperature variation and ±7% across all process, voltage and temperature variations which results in faster read accesses and better sense margins in a memory chip. Additionally, better sense margins translate into better robustness of the read sensing scheme which results in a better yield during fabrication.

In the foregoing specification, embodiments of the invention have been described with reference to numerous specific details that may vary from implementation to implementation. Thus, the sole and exclusive indicator of what is, and is intended by the applicants to be, the invention is the set of claims that issue from this application, in the specific form in which such claims issue, including any subsequent correction. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A device for providing a current reference, said device comprising:

a voltage source for supplying voltage, wherein said voltage source is a positive temperature co-efficient voltage source;

a load coupled to said voltage source, wherein said load has a positive temperature co-efficient; and a voltage compensating circuit coupled to said load and to said current adding circuit, wherein the voltage compensating circuit is configured to compensate for temperature variation by generating a voltage based on a temperature coefficient of the load;

a current adding circuit configured to apply the voltage generated by the voltage compensating circuit to said load in combination with the voltage supplied by said voltage source to produce said current reference, wherein said current reference is substantially constant.

2. The device as described in claim 1, wherein said voltage compensating circuit is a zero temperature co-efficient circuit.

3. The device as described in claim 1, wherein said voltage compensating circuit is operable to supply a voltage reference to compensate for resistance variations associated with temperature changes.

4. The device as described in claim 3, wherein said voltage reference of said voltage compensating circuit equals a product of a first parameter and a second parameter, wherein said first parameter is substantially a constant divided by the first order temperature co-efficient of said load, and wherein temperature coefficient of said load and a reference temperature.

5. The device as described in claim 1, wherein said current reference is substantially independent of temperature variation and substantially equals a constant divided by the product of the value of said load at a reference temperature and its first order temperature co-efficient.

6. The device as described in claim 1, wherein said load is an on-chip resistor.

* * * * *